US008545914B1

(12) United States Patent
Mastroianni

(10) Patent No.: US 8,545,914 B1
(45) Date of Patent: Oct. 1, 2013

(54) FOOD PRODUCT CARRIER SET

(75) Inventor: Michael R. Mastroianni, Crystal Lake, IL (US)

(73) Assignee: Focus Products Group International, LLC, Lincolnshire, IL (US)

( * ) Notice: Subject to any disclaimer, the term of this patent is extended or adjusted under 35 U.S.C. 154(b) by 0 days.

(21) Appl. No.: 13/485,487

(22) Filed: May 31, 2012

(51) Int. Cl.

| | |
|---|---|
| ***B65D 81/32*** | (2006.01) |
| ***B65D 5/50*** | (2006.01) |
| ***B65D 81/34*** | (2006.01) |
| ***B65D 25/54*** | (2006.01) |
| ***B65D 1/34*** | (2006.01) |
| ***B65D 6/04*** | (2006.01) |
| ***B65D 21/00*** | (2006.01) |
| ***B65D 85/62*** | (2006.01) |
| ***B65D 6/28*** | (2006.01) |
| ***B65D 8/18*** | (2006.01) |

(52) U.S. Cl.
USPC ..... 426/115; 426/119; 426/128; 426/394; 206/769; 206/736; 206/562; 206/564; 206/508; 220/4.21; 220/507; 220/521

(58) Field of Classification Search
USPC ..... 206/769, 762, 765, 45.2, 752, 736, 206/562–564, 508; 426/115, 119, 128, 394; 220/4.21, 507, 521
See application file for complete search history.

(56) References Cited

U.S. PATENT DOCUMENTS

| | | | | |
|---|---|---|---|---|
| 3,197,058 | A * | 7/1965 | Hale | 220/23.6 |
| 3,389,851 | A * | 6/1968 | Clark | 206/508 |
| 3,483,908 | A * | 12/1969 | Donovan | 221/260 |
| 4,055,670 | A * | 10/1977 | Belmont | 426/119 |
| 4,114,760 | A * | 9/1978 | Entenmann | 206/562 |
| D396,999 | S * | 8/1998 | Boothe | D7/610 |
| 6,003,671 | A * | 12/1999 | McDonough et al. | 206/493 |
| 6,231,906 | B1 * | 5/2001 | Alessi | 426/119 |
| 6,450,343 | B1 * | 9/2002 | Arnaldi | 206/769 |
| D515,363 | S * | 2/2006 | Driggers et al. | D7/610 |
| D553,902 | S * | 10/2007 | Barber | D7/357 |
| D572,539 | S * | 7/2008 | Swinford et al. | D7/610 |
| 7,802,684 | B2 * | 9/2010 | Shew et al. | 206/541 |
| D638,254 | S * | 5/2011 | Barber | D7/354 |
| D638,255 | S * | 5/2011 | Barber | D7/354 |
| D659,483 | S * | 5/2012 | Dagan et al. | D7/610 |
| 8,317,024 | B1 * | 11/2012 | Persi | 206/508 |
| 2008/0121552 | A1 * | 5/2008 | Anderson et al. | 206/567 |
| 2013/0071531 | A1 * | 3/2013 | Dagan et al. | 426/389 |

* cited by examiner

*Primary Examiner* — Rena Dye
*Assistant Examiner* — Danny Chen
(74) *Attorney, Agent, or Firm* — Thompson Coburn LLP

(57) ABSTRACT

A carrier for food products such as muffins and cupcakes includes a pan and a cover. The pan including multiple pan wells that project from an upper surface thereof. At least some of the pan wells each includes an opening in respective bottom surfaces thereof. The cover includes multiple cover wells or supports projecting from a surface thereof, each corresponding to one of the pan wells. At least some of the cover wells each includes a support extending from a bottom surface thereof. The cover secures to and substantially covers the pan in a first configuration. The pan nests on the cover in a second configuration such that the supports project through a respective one of the openings.

21 Claims, 8 Drawing Sheets

FOOD PRODUCT CARRIER SET

The present invention relates to an accessory to display and transport food products, and more particularly, an accessory to display and transport baked goods such as muffins or cupcakes.

Conventionally, baked goods such as cupcakes or muffins (hereinafter, "food product") are baked in a pan having wells or pockets to hold the individual food product. The pan can be metallic or made of a more flexible material such as silicone. However, such pans are not convenient for display and removal of the food product. The top of the food product, for example, a "muffin top," often adheres to the pan surrounding the perimeter of an individual well, and it often becomes necessary to scrape the food product off of the pan in order to remove it. Frosting disposed on the food product may also become marred when attempting to remove the food product with fingers in a conventional pan. Thus, the conventional pan design often results in inconvenience and delay in displaying and removing food product from a pan.

Additionally, conventional cupcake/muffin pans are sometimes difficult to transport with the food product therein or do not provide a convenient manner in which to store the product. It is often desirable to store food products such as cupcakes and muffins in an airtight container in order to maintain their freshness. Thus, the process may involve placing the entire pan into an even larger container or removing each individual food product and placing it into a separate carrier that may or may not be specially designed for cupcakes/muffins. This problem is especially pronounced with regard to decorated food products, such as cupcakes, which may have taken hours to delicately decorate.

Accordingly, the present invention attempts to remedy the problems in the conventional art.

SUMMARY

In one embodiment, the present invention includes a food carrier comprising a pan and a cover. The pan includes a plurality of pan wells projecting from an upper surface thereof that each includes an opening in respective bottom surfaces thereof. The cover includes a plurality of cover wells projecting from a surface thereof that each includes a raised support, which may be in the form of a platform, extending from a bottom surface thereof. The cover secures to and substantially covers the pan in a first configuration. Additionally, the pan nests on the cover in a second configuration such that the raised supports or platforms project through a respective one of the openings.

In another embodiment, the present invention a pan includes a food carrier comprising a pan and a cover. The pan includes a plurality of pan wells projecting from an upper surface thereof that each includes an opening in respective bottom surfaces thereof. The cover includes a plurality of raised supports or platforms extending upward from a top surface of the cover. The cover secures to and substantially covers the pan in a first configuration. Additionally, the pan nests on the cover in a second configuration such that the raised supports or platforms project through a respective one of the openings.

Other aspects of the invention will become apparent by consideration of the detailed description and accompanying drawings.

DETAILED DESCRIPTION

Figure 1:
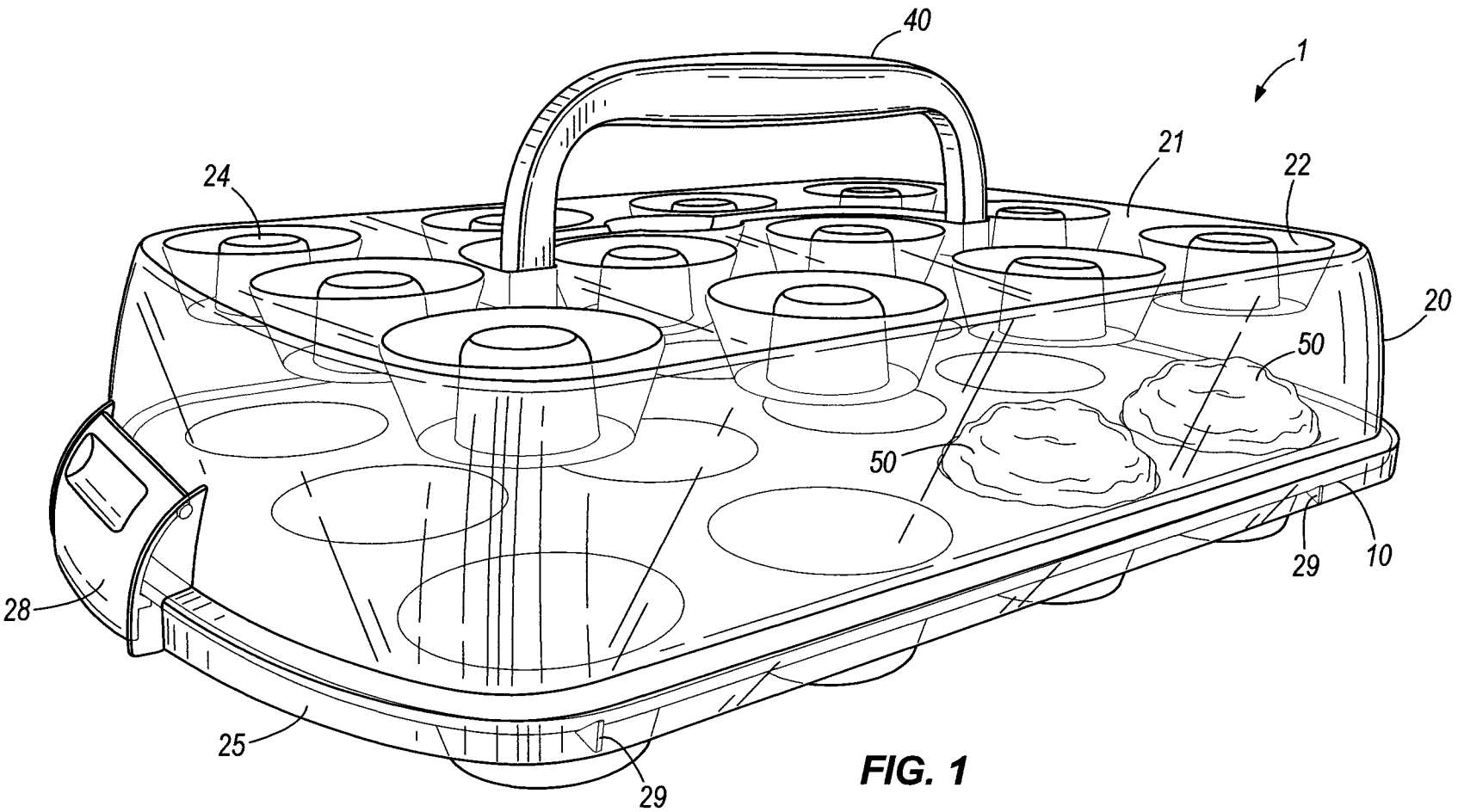
FIG. 1 is a perspective view of a food product carrier set in a transport configuration according to an embodiment of the invention.

Before any embodiments of the invention are explained in detail, it is to be understood that the invention is not limited in its application to the details of construction and the arrangement of components set forth in the following description or illustrated in the above-described drawings. The invention is capable of other embodiments and of being practiced or of being carried out in various ways.

FIGS. 1-5 show an embodiment of the food product carrier set 1, which may function as a cupcake carrier set, a muffin carrier set, or similar food product carrier set. Although the terms "cupcake carrier set" or "muffin carrier set" are used herein, the food product carrier set 1 can be used to display and transport a variety of other food products 50, including, but not limited to, brownies. The cupcake carrier set 1 includes a pan 10 and a cover 20. The cupcake carrier set 1 may be used in a transport or storage configuration, suitable to transport cupcakes, and a display configuration suitable to display or decorate cupcakes.

The pan 10 may be formed of a metallic material, such as tin or aluminum, or another material suitable to hold food products 50 being baked in an oven (not shown). The pan 10 shown in FIGS. 1-4 has a generally rectangular shape, but may have any other shape known in the art, such as square or circular. The pan 10 may be formed of a non-stick material or coated with any non-stick material known in the art. The pan 10 includes a generally planar top surface 11 from which a plurality of generally circular wells 12 project downwardly. The perimeter of the pan 10 is surrounded by a downwardly extending lip 15 that secures to the cover 20 (further described below).

Figure 2:
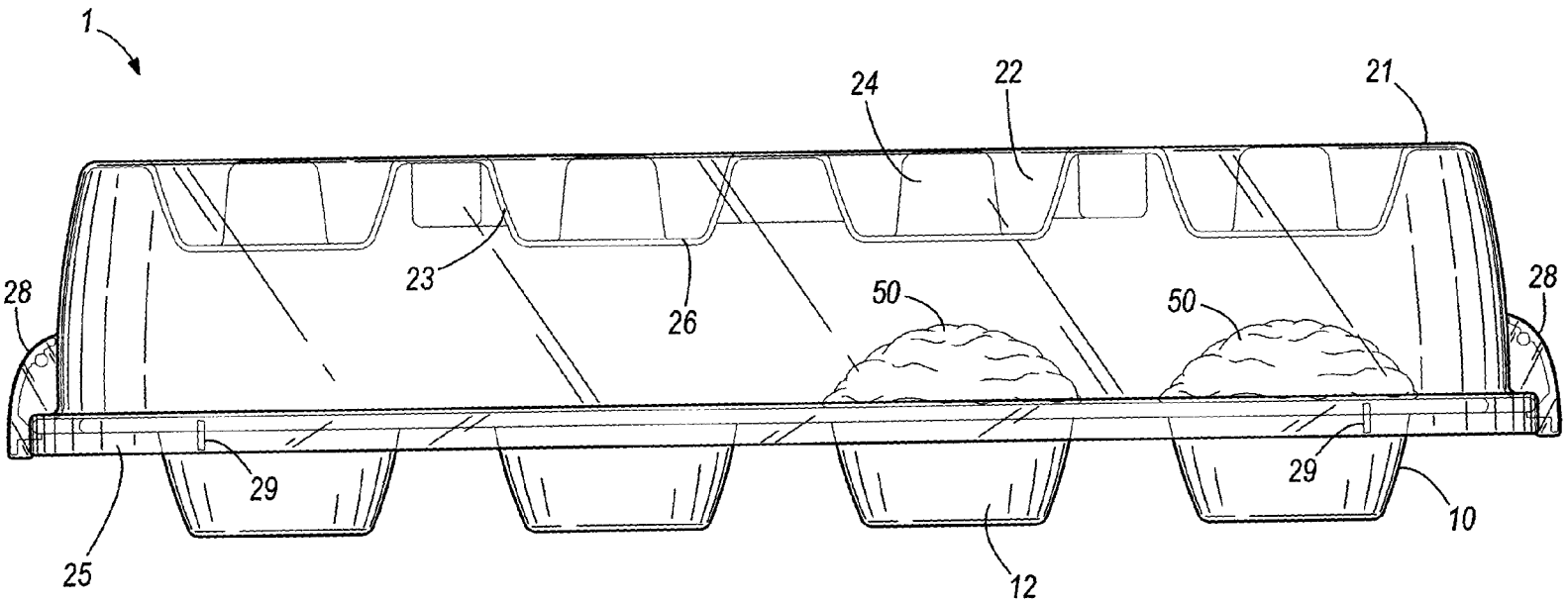
FIG. 2 is a side view of the food product carrier set of FIG. 1.
Figure 3:
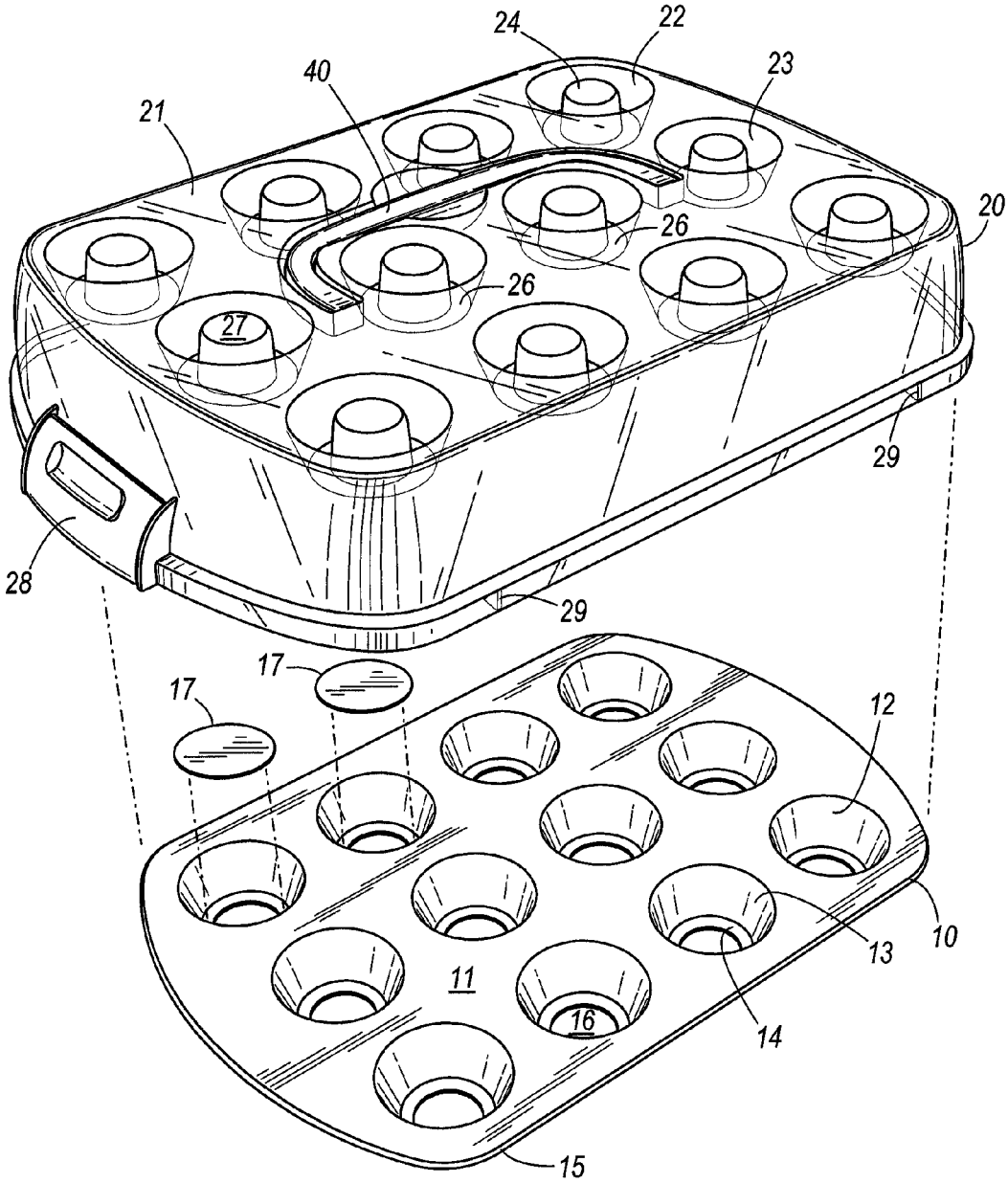
FIG. 3 is an exploded perspective view of the food product carrier set of FIG. 1.
Figure 4:
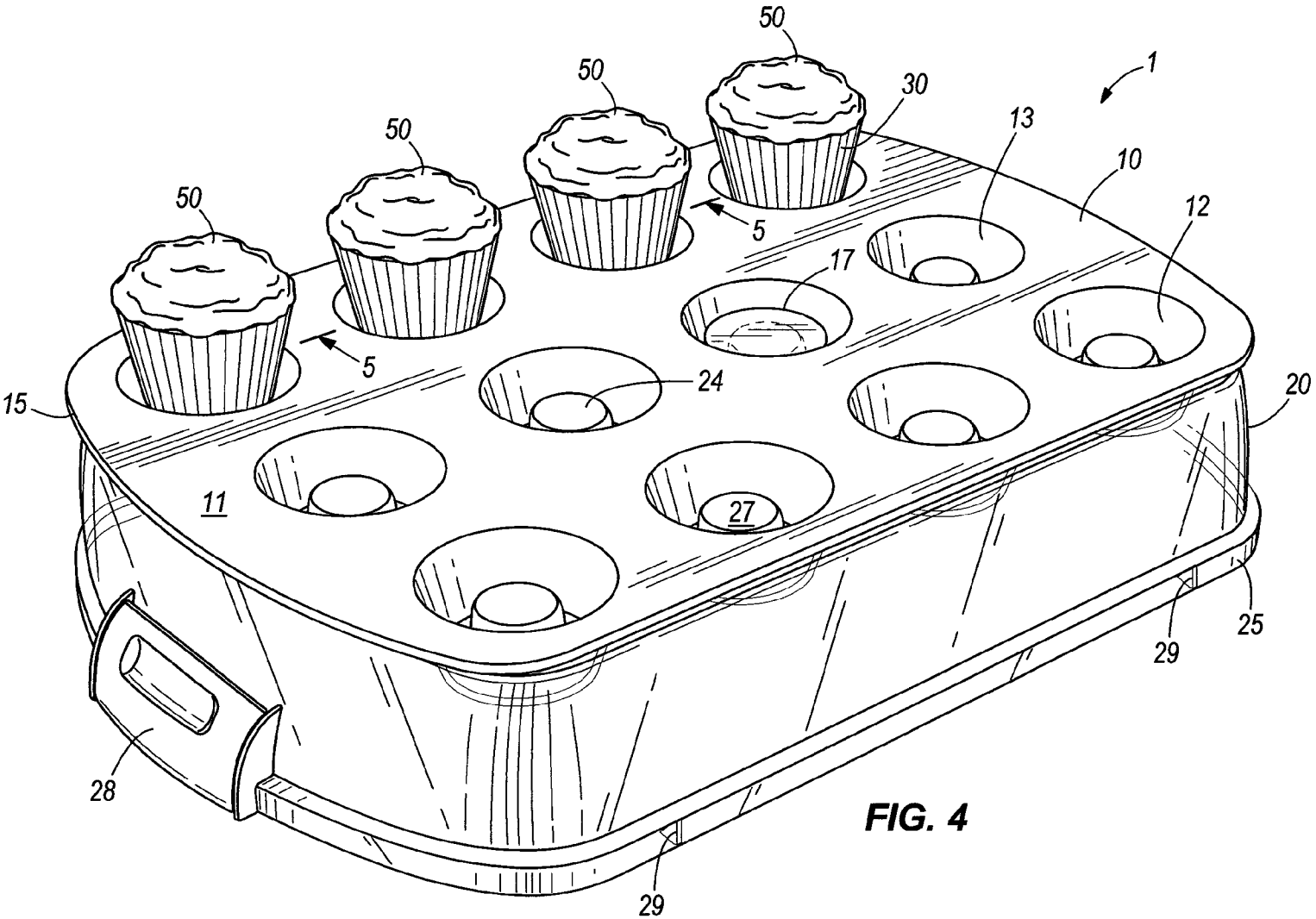
FIG. 4 is a perspective view of the food product carrier set of FIG. 1 in a display configuration.
Figure 5:
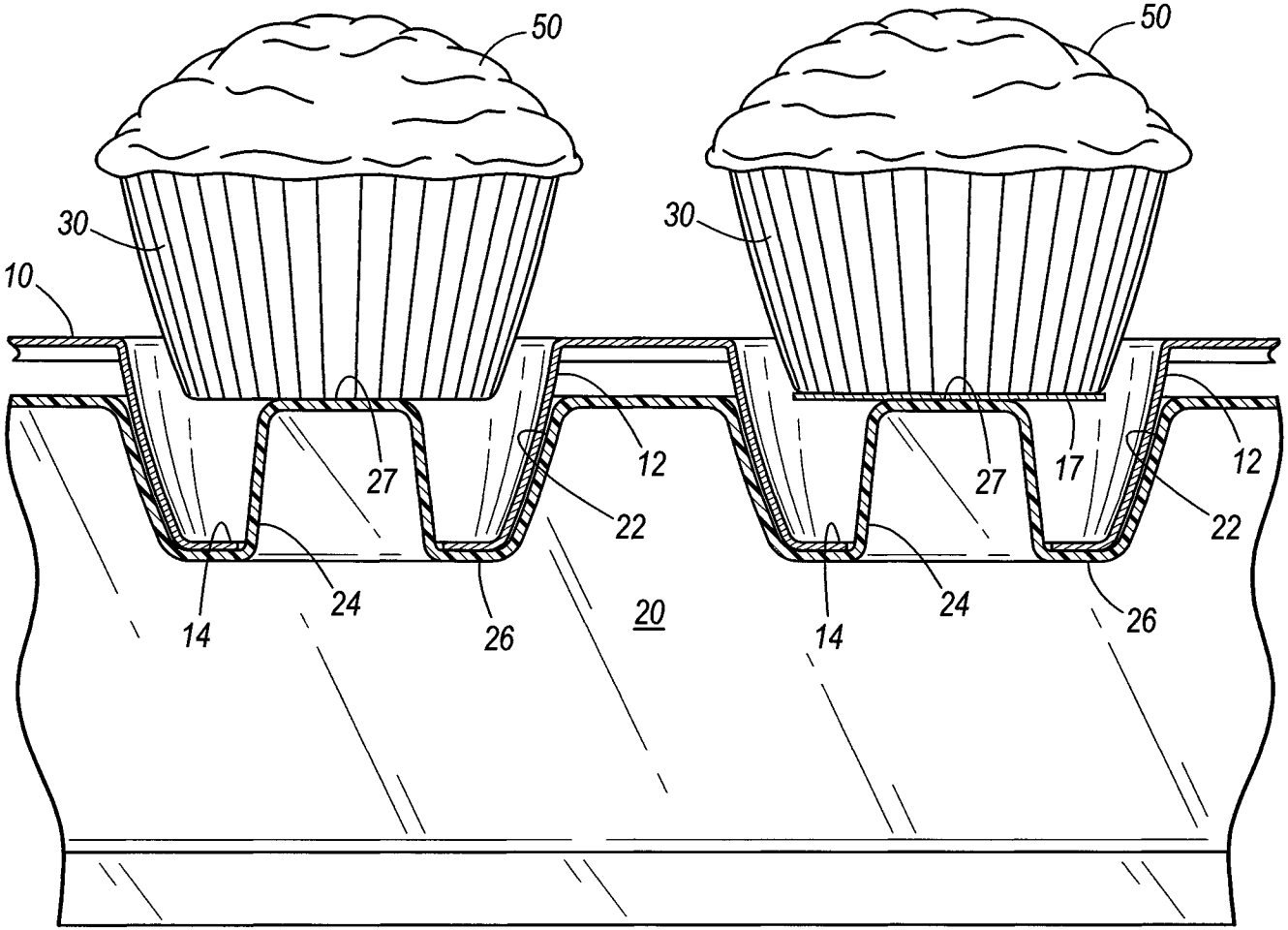
FIG. 5 is a cross-sectional view of the pan and cover taken along line 5-5 in FIG. 4. For clarity, the food product 50 is not shown in cross-section.
Figure 7:
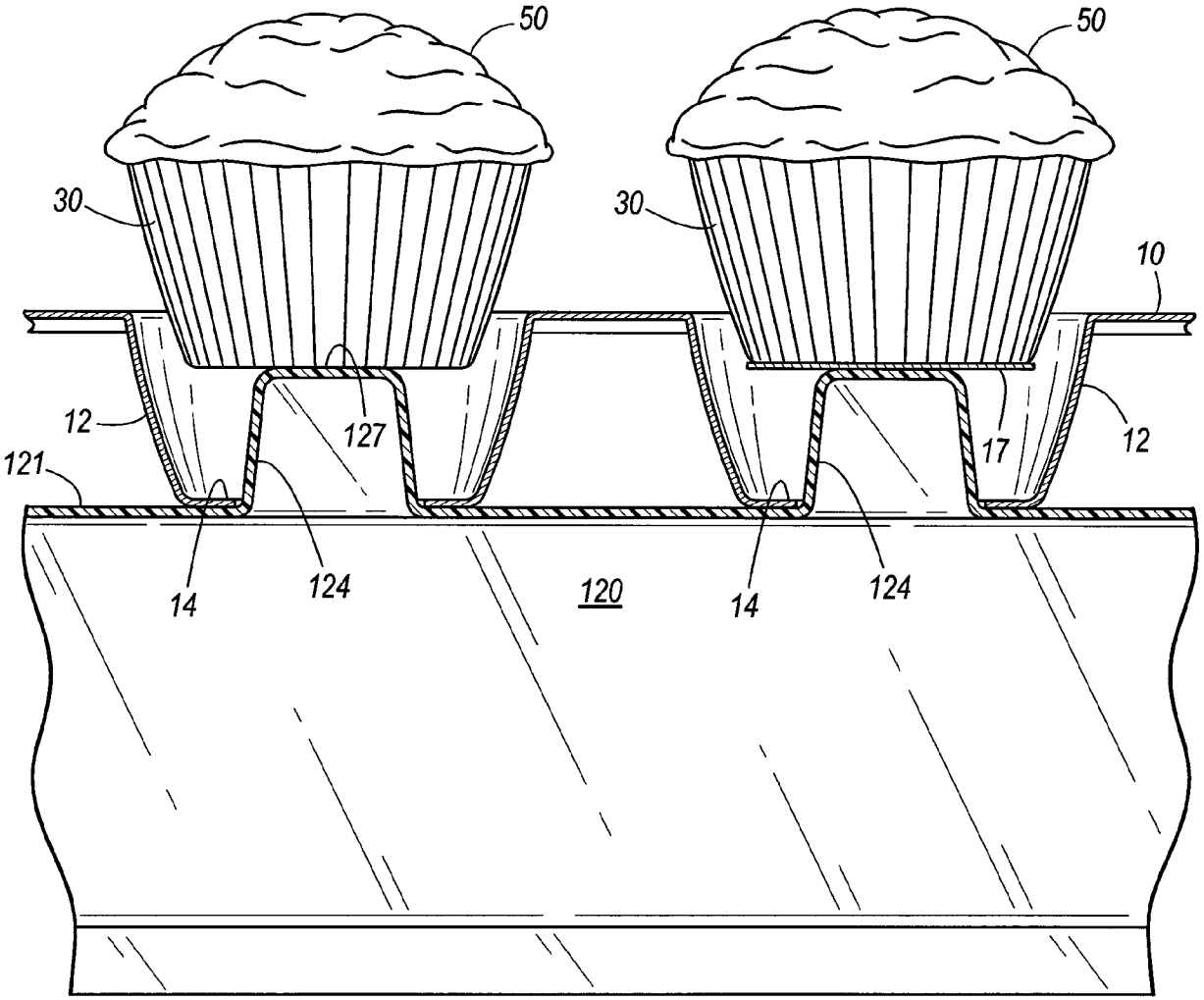
FIG. 7 is a cross-sectional view of the pan and cover taken along line 7-7 in FIG. 6. For clarity, the food product 50 is not shown in cross-section.

As best viewed in FIGS. 3, 5, and 7, each well 12 includes a side wall 13 extending downwardly and inwardly at an angle with the larger, top end being open. The side wall 13 blends into a bottom end that is bounded by a generally circular bottom rim 14 defining an opening 16. A removable disc 17 may be optionally placed on the bottom rim 14 to cover the opening 16 and provide a bottom surface to support the food product 50 placed in the well 12. A total of twelve wells 12 are shown in FIGS. 1-4 disposed in a plurality of rows and columns. The number of wells 12, rows, and columns is not limited.

As best viewed in FIG. 3, the cover 20 has a shape generally corresponding to the shape of the pan 10 and includes a generally planar top surface 21 from which a plurality of generally circular wells 22 protrude downwardly. The cover 20 may be made out of a thin-gauge resilient plastic and is preferably transparent or partially-transparent to view the food products 50 placed within the set 1 during transport.

Alternatively, the cover 20 may be formed wholly or partially of metal. The lower perimeter of the cover 20 is surrounded by a downwardly extending rib 25 having spaced apart notches 29 that secure to the lip 15 of the pan 10 via a mechanical connection such as a snap fit. The cover 20 may include additional locking mechanisms (latches 28 in FIGS. 1-4) to further secure the cover 20 to the pan 10. To facilitate easier transport of the set 1, the cover 20 may also include a fold-down handle 29, which preferably nests within the top surface 21 for storage, as shown in FIG. 3.

As best viewed in FIGS. 2 and 5, each well 22 includes a side wall 23 extending downwardly and inwardly at an angle with a larger, open top end. The side wall 23 blends into a closed bottom end. Extending upwards from the bottom end is a support 24, which may take the form of a platform, as shown in FIGS. 2 and 5. The bottom end of the well 22 includes a ring 26 surrounding the support 24 and sized so as to receive the rim 14 when the cupcake set is in the display configuration of FIG. 4. The size and diameter of the top of the well 22 within the top surface 21 of the cover 20 is approximately equal to the size and diameter of the top of the well 12 within the top surface 11 of the pan 10.

As can be seen in FIGS. 4-5, the wells 22 are sized and shaped so that wells 12 can rest within wells 22. The depth of the wells 22 and the overall height of the cover 20 are selected to ensure that a food product 50 placed within the well 12 will not contact the well 22 there-above when the cover 20 is attached to the pan 10 in the transport configuration. A total of twelve wells 22 are shown in FIGS. 1-4 disposed in a plurality of rows and columns, each well 22 corresponding to one of the wells 12.

With continued reference to FIGS. 4-5, the supports 24 have a generally frustoconical shape with a substantially flat top surface 27 that is sized to fit through the bottom opening 16 in pan walls 12 and configured to support a food product 50 placed thereon. The top surface 27 of the support 24 preferably has a height less than that of top surface 21 of the cover 20 so that the side wall 23 of the well 22 can help maintain the food product 50 in the well 22.

Food products 50 such as cupcakes or muffins may be baked in the pan 10 as follows. A liner 30, typically made of thin paper, is placed in respective wells 12 so that the bottom of the liner 30 rests upon and is supported by the bottom rim 14 according to a total number of food products 50 to be baked. Each liner 30 placed in a well 12 is then filled with raw batter of the food product 50 to be baked in an oven. Each liner 30 thus forms a self-contained baking compartment to bake an individual food product, such as a muffin or cupcake.

After baking is complete, the pan 10 is removed from the oven and the baked food products 50 are allowed to cool. As shown in FIG. 4, after the food products 50 have cooled, the pan 10 is nested on top of the lid 20 in the display configuration, so that the wells 12 in the cooking pan 10 align with the cover wells 22 and supports 24 of the lid 20 protrude through the bottom of the wells 12. Thereby, the food products 50 are supported in their liners 30 on the supports 24 in a raised position above the bottom of each well 12 so that the food products 50 may then be easily served or decorated.

To transport the food products 50 in the transport configuration, the pan 10 is removed from the top of the cover 20, and the cover 20 is placed on top of the pan 10, as in FIG. 1. The rib 25 and optionally the latches 28 of the cover 20 are then secured to the lip 15. The cupcake carrier set 1 may then be lifted by the handle 29 and transported. The cover thereby provides a substantially airtight container for the food products 50, allowing the food products 50 to remain fresh.

Figure 6:
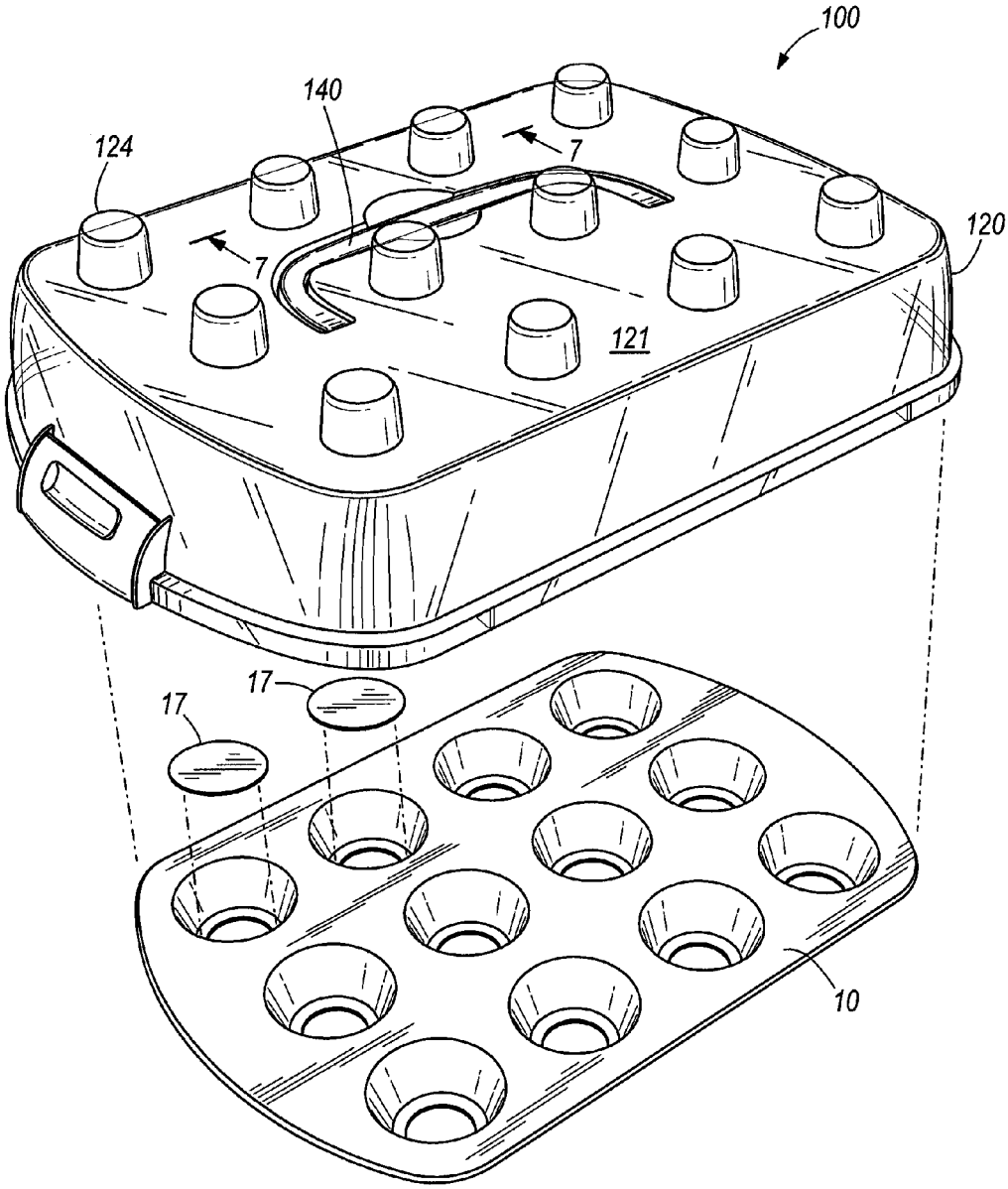
FIG. 6 is an exploded perspective view of an alternative embodiment of the invention.

FIGS. 6-7 show an alternative embodiment of the food product carrier set 100. The set 100 includes a pan 10 identical to the pan 10 of the set 1 and a cover 120. Similar to the cover 20, the cover 120 is sized to fit around and secure to the pan 10, and includes a handle 140 to facilitate easy transport of the set 100. The cover 120 may also be made of the same or similar materials as the cover 20 and may include the same locking mechanisms to secure to the pan 10. However, as best viewed in FIG. 6, the cover 120 includes supports 124 protruding upwardly from a top surface 121 of the cover 120. With reference to FIG. 7, in one embodiment, the supports 124 have a generally frustoconical shape with a substantially flat top surface 127 that is sized to fit through the bottom opening 16 in pan walls 12 and configured to support a food product 50 placed thereon.

Figure 8A:
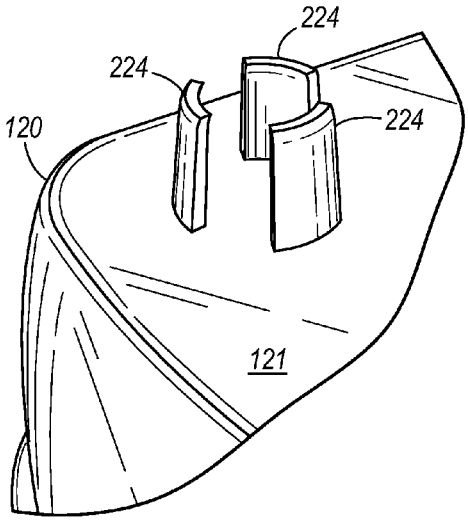
FIGS. 8*a*-8*d* are perspective views of alternative embodiments of the pan of FIG. 6.
Figure 8B:
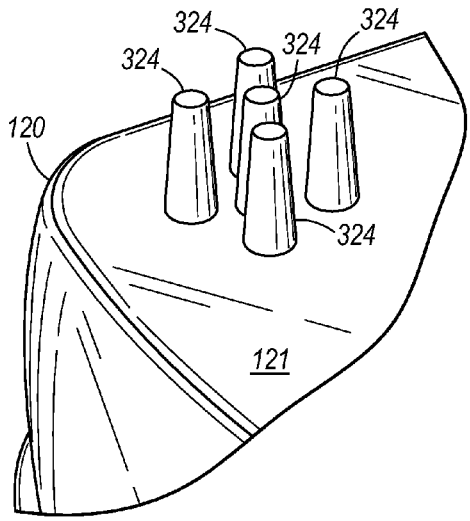
Figure 8C:
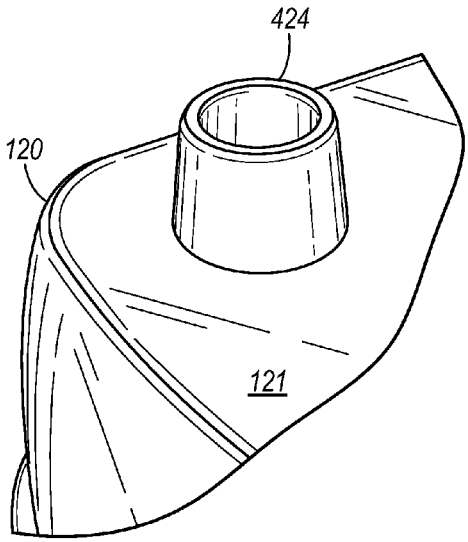
Figure 8D:
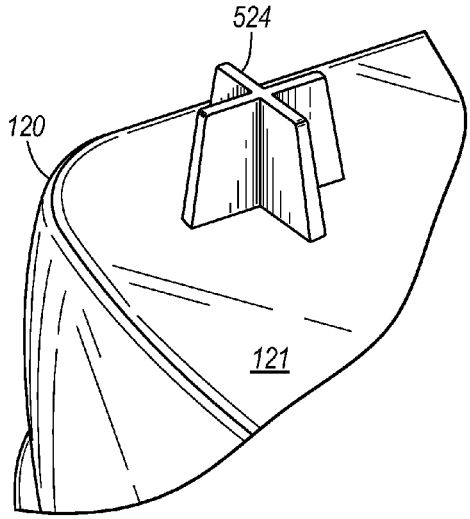

FIGS. **8*a*-8*d* show additional alternative embodiments of the supports. FIG. 8*a* shows a plurality of supports 224 generally in the shape of tabs spaced apart from each other and forming a generally circular shape. FIG. 8*b* shows a plurality of supports 324 in the form of posts. FIG. 8*c* shows a support 424 having a hollow furstoconical shape with an open upper side. FIG. 8*d* shows a support 524 having an X-shape. Each of the alternative supports 224, 324, 424, 524 are sized to fit through the bottom opening 16 in pan walls 12 and are configured to support a food product 50 placed thereon. The cover 20, 120 may include identical supports 24, 124, 224, 324, 424, 524, or may include various combinations of the supports 24, 124, 224, 324, 424, 524**.

After baking is complete using the food product carrier set 100, the pan 10 is removed from the oven and the baked food products 50 are allowed to cool. After the food products 50 have cooled, the pan 10 is nested on top of the lid 120 in the display configuration, so that the supports 124, 224, 324, 424, 524 of the lid 120 protrude through the bottom of the wells 12. Thereby, the food products 50 are supported in their liners 30 on the supports 124, 224, 324, 424, 524 in a raised position above the bottom of each well 12 so that the food products 50 may then be easily served or decorated.

Although embodiments of the invention have been shown and described, it is to be understood that various modifications, substitutions, and rearrangements of layers and materials, as well as other uses of the invention can be made by those skilled in the art without departing from the scope and spirit of one or more independent aspects of the invention as described.

The invention claimed is:

1. A carrier for food products, comprising:

a pan including a plurality of pan wells projecting from a surface thereof, at least some of the pan wells each including an opening in respective bottom surfaces thereof; and a cover including a plurality of cover wells projecting from a surface thereof, at least some of the cover wells each including a support extending from a bottom surface thereof, wherein the cover secures to and substantially covers the pan in a first configuration, and the pan nests on the cover in a second configuration such that the supports project through respective openings.

2. The carrier according to claim 1, wherein the first configuration is a transport configuration in which a food product disposed within at least one pan well is supported by a bottom surface of the at least one pan well.

3. The carrier according to claim 1, wherein the second configuration is a display configuration in which a food product disposed within at least one pan well is supported by a respective support projecting through a respective opening formed in the at least one pan well.

4. The carrier according to claim 1, wherein the supports have a height less than a height of the surface of the cover relative to a bottom of the cover.

5. The carrier according to claim 1, wherein the cover wells are disposed over the respective pan wells in the transport configuration.

6. The carrier according to claim 1, wherein the cover includes a locking mechanism to secure the cover to the pan in the transport configuration.

7. The carrier according to claim 1, wherein the pan is at least partially made of metal and the cover is at least partially made of a plastic material.

8. The carrier according to claim 1, wherein a number of the cover wells is equal to a number of the pan wells.

9. The carrier according to claim 1, wherein the pan includes a nonstick coating.

10. The carrier according to claim 1, wherein the surface of the cover is an upper surface and the cover wells extend downwardly from the upper surface.

11. The carrier according to claim 1, wherein each of the pan wells includes a pan rim surrounding the opening, the pan rim configured to support a bottom of a liner that holds the food product in the first configuration.

12. The carrier according to claim 11, wherein each of the cover wells includes a cover rim surrounding the support, the cover rim configured to support at least one of the pan rims in the second configuration.

13. The carrier according to claim 1, wherein the supports have a frustoconical shape.

14. The carrier according to claim 1, further comprising a support surface removably placed in at least one of the pan wells and covering the opening in the at least one of the pan wells in the first configuration.

15. The carrier according to claim 14, wherein the cover is attached to the pan in a substantially airtight manner in the first configuration.

16. The carrier according to claim 14, wherein the support surface rests on top of the supports in the second configuration.

17. The carrier according to claim 1, wherein the supports each comprise a single horizontal upper surface.

18. The carrier according to claim 1, wherein the supports each comprise a plurality of horizontal upper surfaces.

19. A carrier for food products, comprising:

a pan configured to bake food products therein, the pan including a plurality of pan wells extending downward from an upper surface thereof to hold individual food products, at least some of the pan wells each including an opening in respective bottom surfaces thereof; and a cover including a plurality of cover wells extending downward from an upper surface thereof, at least some of the cover wells each including a support extending upward from a bottom surface thereof, wherein the cover removably secures to and substantially covers the pan in a first configuration such that the cover wells are disposed substantially directly above respective pan wells, and the pan nests on the cover in a second configuration such that the supports project through respective openings to support the food products thereon.

20. The carrier according to claim 19, wherein the supports each comprise a single horizontal upper surface.

21. The carrier according to claim 19, wherein the supports each comprise a plurality of horizontal upper surfaces.

* * * * *